US007223351B2

(12) United States Patent
Sharma et al.

(10) Patent No.: US 7,223,351 B2
(45) Date of Patent: May 29, 2007

(54) FIRE EXTINGUISHING MIXTURES, METHODS AND SYSTEMS

(75) Inventors: Vimal Sharma, El Dorado, AR (US); W. Douglas Register, Lafayette, IN (US); James Harris, El Dorado, AR (US); Thomas F. Rowland, El Dorado, AR (US); Mark Cisneros, West Lafayette, IN (US)

(73) Assignee: Great Lakes Chemical Corporation, West Lafayette, IN (US)

( * ) Notice: Subject to any disclaimer, the term of this patent is extended or adjusted under 35 U.S.C. 154(b) by 336 days.

(21) Appl. No.: 10/418,781

(22) Filed: Apr. 17, 2003

(65) Prior Publication Data

US 2004/0217322 A1 Nov. 4, 2004

(51) Int. Cl.

| | |
|---|---|
| ***A62D 1/00*** | (2006.01) |
| *A62C 11/00* | (2006.01) |
| *A62C 2/00* | (2006.01) |
| *A62C 3/00* | (2006.01) |

(52) U.S. Cl. ..... 252/2; 252/2; 169/30; 169/45; 169/46; 169/47; 169/9; 169/14; 169/44

(58) Field of Classification Search ..... 252/2, 252/364; 169/30, 45, 46, 47, 9, 14, 44
See application file for complete search history.

(56) References Cited

U.S. PATENT DOCUMENTS

| | | | |
|---|---|---|---|
| 1,132,636 | A | 3/1915 | Taylor et al. |
| 1,926,395 | A | 9/1933 | Midgley, Jr. |
| 1,926,396 | A | 9/1933 | Midgley, Jr. |
| 2,005,706 | A | 6/1935 | Daudt et al. |
| 2,005,707 | A | 6/1935 | Daudt et al. |
| 2,021,981 | A | 11/1935 | Bichowsky |
| 2,456,028 | A | 12/1948 | Simons |
| 2,494,064 | A | 1/1950 | Simons et al. |
| 2,519,983 | A | 8/1950 | Simons |
| 2,576,823 | A | 11/1951 | Benning et al. |
| 2,697,124 | A | 12/1954 | Mantell et al. |
| 2,900,423 | A | 8/1959 | Smith et al. |
| 2,942,036 | A | 6/1960 | Smith et al. |
| 3,258,500 | A | 6/1966 | Swamer et al. |

(Continued)

FOREIGN PATENT DOCUMENTS

| | | |
|---|---|---|
| CA | 1162511 | 5/1991 |

(Continued)

OTHER PUBLICATIONS

National Fire Protection Association; NFPA 2001 "Clean Agent Fire Extinguishing Systems" pp. 2001-1 and 2001-14.

(Continued)

*Primary Examiner*—Kevin Shaver
*Assistant Examiner*—James S. Hogan
(74) *Attorney, Agent, or Firm*—Daniel Reitenbach

(57) ABSTRACT

Fire extinguishing mixtures, systems and methods are provided. The fire extinguishing mixtures can include one or more extinguishing compounds, such as, for example, one or more of fluorocarbons, fluoroethers, and fluorocarbons. The fire extinguishing mixtures can also include one or more of nitrogen, argon, helium and carbon dioxide. In an exemplary aspect the extinguishing mixture includes an extinguishing compound, a diluent gas and water.

45 Claims, 1 Drawing Sheet

U.S. PATENT DOCUMENTS

| | | | | |
|---|---|---|---|---|
| 3,436,430 | A | 4/1969 | Hall et al. | |
| 3,479,286 | A | 11/1969 | Clun et al. | |
| 3,636,173 | A | 1/1972 | Gardner | |
| 3,656,553 | A | 4/1972 | Rainaldi et al. | |
| 3,715,438 | A | 2/1973 | Huggett | |
| 3,803,241 | A | 4/1974 | Stolkin et al. | |
| 3,822,207 | A | 7/1974 | Howard et al. | |
| 3,844,354 | A | 10/1974 | Larsen | |
| 4,014,799 | A | 3/1977 | Owens | |
| 4,158,023 | A | 6/1979 | von Halasz | |
| 4,225,404 | A | 9/1980 | Dietrich et al. | |
| 4,226,728 | A | 10/1980 | Kung | |
| 4,459,213 | A | 7/1984 | Uchida et al. | |
| 4,536,298 | A * | 8/1985 | Kamei et al. | 252/8.05 |
| 4,668,407 | A | 5/1987 | Gerard et al. | |
| 4,826,610 | A | 5/1989 | Thacker | |
| 4,851,595 | A | 7/1989 | Gumprecht | |
| 4,876,405 | A | 10/1989 | Gervasutti | |
| 4,885,409 | A | 12/1989 | Gardano et al. | |
| 4,954,271 | A | 9/1990 | Green | |
| 5,040,609 | A | 8/1991 | Dougherty, Jr. et al. | |
| 5,043,491 | A | 8/1991 | Webster et al. | |
| 5,057,634 | A | 10/1991 | Webster et al. | |
| 5,068,472 | A | 11/1991 | Webster et al. | |
| 5,068,473 | A | 11/1991 | Kellner et al. | |
| 5,084,190 | A | 1/1992 | Fernandez | |
| 5,115,868 | A | 5/1992 | Dougherty, Jr. et al. | |
| 5,141,654 | A | 8/1992 | Fernandez | |
| 5,146,018 | A | 9/1992 | Kellner et al. | |
| 5,171,901 | A | 12/1992 | Gassen et al. | |
| 5,177,273 | A | 1/1993 | Bruhnke et al. | |
| 5,220,083 | A | 6/1993 | Webster et al. | |
| 5,268,343 | A | 12/1993 | Hopp et al. | |
| 5,302,765 | A | 4/1994 | Manzer et al. | |
| 5,364,992 | A | 11/1994 | Manogue et al. | |
| 5,416,246 | A | 5/1995 | Krespan et al. | |
| 5,430,204 | A | 7/1995 | Manogue et al. | |
| 5,446,219 | A | 8/1995 | Manogue et al. | |
| 5,523,501 | A | 6/1996 | Kellner et al. | |
| 5,562,861 | A | 10/1996 | Nimitz et al. | |
| 5,621,151 | A | 4/1997 | Manogue | |
| 5,621,152 | A | 4/1997 | Jansen et al. | |
| 5,723,699 | A | 3/1998 | Miller et al. | |
| 5,730,894 | A | 3/1998 | Minor | |
| 5,902,911 | A | 5/1999 | Rao et al. | |
| 5,919,994 | A | 7/1999 | Rao | |
| 6,018,083 | A | 1/2000 | Manogue et al. | |
| 6,065,547 | A * | 5/2000 | Ellis et al. | 169/89 |
| 6,156,944 | A | 12/2000 | Pham et al. | |
| 6,211,135 | B1 | 4/2001 | Miller et al. | |
| 6,281,395 | B1 | 8/2001 | Nappa et al. | |
| 6,291,729 | B1 | 9/2001 | Rao | |
| 6,346,203 | B1 | 2/2002 | Robin et al. | |
| 6,376,727 | B1 | 4/2002 | Rao et al. | |
| 6,461,530 | B2 * | 10/2002 | Robin et al. | 252/8 |
| 6,478,979 | B1 * | 11/2002 | Rivers et al. | 252/2 |
| 6,763,894 | B2 * | 7/2004 | Schoenrock et al. | 169/47 |
| 6,849,194 | B2 * | 2/2005 | Robin et al. | 252/8 |

FOREIGN PATENT DOCUMENTS

| | | | |
|---|---|---|---|
| CA | 2081813 | | 10/1992 |
| DE | 1546505 | | 9/1970 |
| DE | 42 03 351 | A1 | 8/1993 |
| EP | 0 039 471 | A1 | 11/1981 |
| EP | 0 349 115 | A1 | 1/1990 |
| EP | 0 383 443 | | 8/1990 |
| EP | 0 434 407 | A1 | 6/1991 |
| EP | 0 434 409 | A | 6/1991 |
| EP | 0 481 618 | A1 | 4/1992 |
| EP | 0 539 989 | A1 | 5/1993 |
| EP | 0 539 989 | B1 | 5/1993 |
| EP | 0 442 075 | B1 | 8/1993 |
| EP | 0 570 367 | B1 | 11/1993 |
| EP | 0 253 410 | A | 1/1998 |
| GB | 428361 | | 9/1930 |
| GB | 428445 | | 5/1935 |
| GB | 468447 | | 8/1937 |
| GB | 698386 | | 10/1953 |
| GB | 790335 | | 2/1958 |
| GB | 902590 | | 8/1962 |
| GB | 1077932 | | 8/1967 |
| GB | 1132636 | | 11/1968 |
| GB | 1359023 | | 7/1974 |
| GB | 1578933 | | 11/1980 |
| GB | 2120666 | | 12/1983 |
| GB | 2370768 | | 7/2002 |
| JP | 51034595 | | 9/1974 |
| JP | 50-50864 | | 4/1975 |
| JP | 52-25679 | | 7/1977 |
| JP | 57-93070 | A | 6/1982 |
| JP | 4-96770 | | 3/1992 |
| RU | 2068718 | C1 | 8/1990 |
| WO | WO 91/02564 | | 3/1991 |
| WO | WO 91/04766 | | 4/1991 |
| WO | WO 96/17813 | | 5/1991 |
| WO | WO 91/12853 | | 9/1991 |
| WO | WO 91/05752 | | 5/1993 |
| WO | WO 93/24586 | | 12/1993 |
| WO | WO 98/50327 | | 6/1996 |
| WO | WO 96/40834 | | 12/1996 |
| WO | WO 98/37043 | | 8/1998 |
| WO | WO 99/26907 | | 11/1998 |
| WO | WO 99/51553 | | 10/1999 |
| WO | WO 99/51555 | | 10/1999 |
| WO | WO 99/62851 | | 12/1999 |
| WO | WO 02/40102 | A2 | 5/2002 |
| WO | WO 02/40102 | A3 | 5/2002 |
| WO | PCT/US02/30729 | | 9/2002 |
| WO | WO 02/078788 | A2 | 10/2002 |
| WO | WO 02/078788 | A3 | 10/2002 |
| WO | WO 02/078790 | A2 | 10/2002 |
| WO | WO 02/078790 | A3 | 10/2002 |
| WO | WO 03/029173 | | 4/2003 |
| WO | 2004/011563 | | 4/2004 |
| WO | PCT/US2004/023917 | | 7/2004 |

OTHER PUBLICATIONS

Journal of Fluorine Chemistry, 2000 "Fire extinguishing ability of perfluoroalkylamines and perfluoroethers . . . ", Fukaya et al., pp. 143-146.

Kirk-Ohmer, "Castor Oil to Chlorosulfuric Acid", 2001, Encyclopedia of Chemical Technology, Third Edition, vol. 5.

Milos Hudlicky, "Chemistry of Organic Fluorine Compounds: A Laboratory Manual with Comprehensive Literature Coverage 2nd (Revised) Edition", 1992, Organic Chemistry Series, Ellis Horwood PTR Prentice Hall.

Moldavaskii, et al., "Technology for the preparation of perfluoro-organic compounds", 1999, Journal of Fluorine Chemistry 94 (1999), pp. 157-167.

Herbert O. House, "Catalytic Hydrogenation and Dehydrogenation", 1972, Modern Synthetic Reactions, Second Edition.

Kvicala, et al., "Preparation of Perhalogenated Chlorofluoropropanes By Halogen Exchange In the Liquid And Vapour Phases And Their Isomer Analyses By $^{19}$F NMR Spectroscopy", 1989, Journal of Fluorine Chemistry 43 (1989), pp. 155-175.

Mettille, et al., "Methods for the Introductions of Hydrogens Into Fluorinated Compounds", 1967, Fluorine Chemistry Reviews, 1 (2), pp. 315-358.

Cisneros, et al., "An Integrated Approach to Achieve Low Environmental Impact in the Special Hazards Fire Suppression Industry".

Petrov, et al., "Isomerization of halopolyfluoroalkanes by the action of aluminum chlorofluoride", 1998, Journal of Fluorine Chemistry 89 (1998), pp. 125-130.
Aggarwal, et al., "Chlorination of Propane and Propylene and Pyrolysis of Perchloropropane", 1968, Petroleum & Hydrocarbons, vol. 3, No. 2, Jul. 1968.
Henne, et al., "Fluorinated Derivatives of Propane and Propylene. V1", 1946, (Contribution from the Department of Chemistry at the Ohio State University) vol. 68, pp. 496-497.
Jiri George Drobny, "Technology of Fluoropolymers", CRC Press, vols. 78-79.
"The Halogenated Extinguishing Agents", Fire Protection Handbook, Fourteenth Edition, National Fire Protection Association, Boston, Section 13, Chapter 4, pp. 13-20 to 13-26.
Fukaya, et al., "Fire extinguishing ability of perfluoroalkylamines and perfluoroethers . . . ", 2000, Journal of Fluorine Chemistry, pp. 143-146.
Burns, et al., "Fluorine compounds in anaesthesia (9). Examination of six aliphatic compounds and four ethers", 1982, Anaesthesia, vol. 37, pp. 278-284.
McFarland, Mack, "Chlorofluorocarbons and ozone", 1989, *Environ. Sci. Technol.,* vol. 23, No. 10, pp. 1203-1207.
Malcomb, J.E., "Report 1177 Interim Report Vaporizing Fire Extinguishing Agents", Augus! 1950, *Engineering Research and Development Laboratories, Petroleum and Distribution Branch,* pp. i-90.
Wuebbles, Donald J., "The Relative Efficiency of a Number of Halocarbons for Destroying Stratospheric Ozone", Jan. 1981, *Lawrence Livermore National Laboratory, University of California,* pp. 1-11.
Wuebbles, Donald J., "Chlorocarbon Emission Scenarios: Potential Impact on Stratospheric Ozone", Feb. 1983, *Journal of Geophysical Research,* vol. 88, No. C2, pp. 1433-1443.
Molina, et al., "Ultraviolet Absorption cross Sections of Several Brominated Methanes and Ethanes of Atmospheric Interest", Feb. 1982, *J. Phys. Chem.,* 1982, 86, 2672-2676.
The United Nations Environment Program, Montreal Protocol Assessment, Technology Review, "Report of the Halons Technical Options Committee", Jun. 1989, Draft for Peer Review.
Larsen, Eric R., "Halogenated Fire Extinguishants: Flame Suppression by a Physical Mechanism?", 1975, *Halogens Research Laboratory, The Dow Chemical Corporation, Midland, Michigan,* pp. 376-402.
Belles, Frank E., "Chemical Action of Halogenated Agents in Fire Extinguishing", 1955, *National Advisory Committee for Aeronautices,* Technical Note 3565, pp. 1-30.
Kauschka, Von Gunther, et al., "Calculation of thermodynamic substance data and reaction balance with poly- and perhalogen hydrocarbons", Oct. 1976, *Chemistry Section of the Humboldt University in Berlin,* vol. 10, pp. 1-22 (translated).
Moore, Jeanne P., et al., "Halon Alternatives Extinguishment Testing", 1989, *Center for Technologies to protect Stratospheric Ozone, New Mexico Engineering Institute, University of New Mexico, Albuquerque, New Mexico,* presented at the International Conference on CFC & Halon Alternatives, Oct. 10-11, 1989, Washington, D.C., pp. 1-8.
Smart, B.E., "Fluorocarbons", 1983, *The Chemistry of Functional Groups,* Supplement D, Chapter 14, pp. 603-655.
Chemical Encyclopedia, "Bolshaya Rossiiskaya Entsiklopedia" Moscow, 1992, *Scientific Publishing House,* vol. 3, Med-Pol.
The United Nations Environment Program, Montreal Protocol Assessment, Technology Review, "Final Report of the Halons - Technical Options Committee", August 1989.
Reid, Robert C., "The properties of gases and liquids", 1987, pp. 153-157.
"Part IV The Evolution of the Montreal Protocol", 1987, Section 4.1 and 4.2, pp. 265-275.
Haynes, Robert G., et al., "Shock-Tube Study of the Pyrolysis of the Halon Replacement Molecule $CF_3CHFCF_3$", 1999, J. Phys. Chem. A, vol. 103, pp. 54-61.
Joint Assessment of Commodity Chemicals No. 24, *Pentalluoroethane* (HFC 125), (ECETOC) May 1994, pp. 14-20.
Kubota, Kazuo, "Current State and Measures Related to Chlorofluorocarbon Regulations, Part I", 1989, *Valqua Review,* vol. 33, No. 2, pp. 1-8 (English translation - pp. 1-18).
Malcolm, J.E., "Halogenated Extinguishing Agents", Part II Research at the Corps of Engineers' Laboratories, 1951, NFPA Quarterly, pp. 119-131.
Nelson, Thomas P., "Findings of the Chlorofluorocarbon Chemical Substitutes International Committee", Apr. 1988, *U.S. Environmental Protection Agency, Air and Energy Engineering Research Laboratory,* EPA/600/9-88/009, pp. i-K6.
Smart, Bruce E., *Fluorinated Organic Molecules,* 1986, Molecular Structure and Energetics, vol. 3, pp. 141, 152.
Tominaga, Takeshi, "Global and Technical Countermeasures Against Flon", 1989, *The Nikkan Kogyo Shinbun, Ltd.,* pp. 134-137, 156-163, 170-174 (English translation).
Creitz, Journal of Research of the National Bureau od Standard, vol. 65A, No. 4, pp. 386396, (1961).
Bryce, H.G., Fire Extinguishing Agents, Industrial Aspects of Fluorine Chemistry, at pp. 354358, vol. 5 of Hudlicky, Milos, Chemistry of Organic Fluorine Compounds (1962).
Hirst, R. and Booth, K., "Measurement of Flame-Extinguishing Concentration", Fire Technology, vol. 13(4), pp. 296 315 (1997).
Final Report on Extinguishing Agents for the Period Sep. 1, 1947 to Jun. 30, 1950 Convering Research Comducted by Purdue Research Foundation and the Department of Chemistry, Purdue University, Contract W14-009-engr 507, Army Engineers Research and Development Laboratories, Fort Belvoir.
Research at the Corps of Engineers Labs, "Halogenated Extinguishing Agents", NFPA Quarterly, pp. 118131 (Oct. 1951).
Banks, Findings of the Chlorofluorocarbon Chemical Substitute International Committee, Appendix A: Summary Report A-1-A-5, May 4, 1987.
Index to Decisions and Annexes of the Parties to the Montreal Protocol, Helsinki Meeting, 1989, pp. 79, 128, 241.
Hogue, Cheryl, "Substitutes for Halons: No One chemical Cuitable," Intl. Environment Reporter, Nov. 21, 1990, pp. 493-495.
Federal Register, vol. 58, No. 90, May 12, 1993, pp. 2813628149 and 28176-28185.
"Fm-200®, The New Solution for Fire Protection," Jun. 1993, 11 pages.
Moore, P.E., "Fluorocarbon Halon Alternatives," Fire Safety Engineering, 1997, 3 pages.
Hampson, Roger D., "The Success of FM200(TM)," Fire Saftey Engineering, vol. 2, No. 1, 1995, pp. 2123.
"Kidde FM-200® Fire Suppression Systems," May 1994, 2 pages.
"Real-Scale Halon Replacement Testing," CFC/HalonNews, Mar. 1996, one page.
FM-200® Waterless Fire Protection for Marine Applications, 2003, 8 pages.
Buckland, Robert E., "When It Comes to Fire Protection- Speed Counts," Automotive Industry Agenda,Mar. 2002, one page.
Bennett, Mike, "Halon Replacement for Aviation Systems," International CFC and Halon Alternatives Conference, Sep/ 29 through Oct. 1, 1992, Washington D.C., pp. 667-6672.
Thornton, Al, "FM-200, A Unique Fire Fighting Agent," 1997 Taipei International Conference on Ozone Layer Protection, Dec. 10, 1997, 10 pages.
The Appeal Decision in invalidation action for Patent No. 2580075, 10 pages (translation).
International Fire Protection, "Great Lakes Chemical Corporation-Company Profile," An MDM Publication, Issue 4, Nov./Dec. 2000, 4 pages.
http://www.e1.greatlakes.com/wfp/product/jsp/articles.jsp "Airports and Satellite Installations Protected by FM200®," "Healthcare Facilities Protected by FM200® Waterless Fire Protection Systems," "Museums and Cultural Landmarks protected by FM-200®," and "Casino Properties Protected by FM200®,".
Nimitz, et al., "Halcoarbons as Halon Replacements: Technology Review and Initiation," New Mexico Engineering Research Institute, University of New Mexico, Final Report, Mar. 1991, 141 pages.

"A Review of the Toxic and Asphyxiating Hazards of Clean Agent Replacements for Halon 1301," A Report by the Halon Alternatives Group, Feb. 1995, 22 pages.
Hart-Winchester, "A Burning Issus: What Products Will Replace Halon 1301?" The Computer Operations Manager, Mar./Apr. 1995, pp. 13-18.
Maranghides, et al., "Discharge System Modifications: Real Scale Halon 181 Replacement Testing," Halon Options Technical Working Conference, Albuquerque, New Mexico, May 79, 1996, 12 pages.
Ellis, "Pleasure Boat Fire Extinguisher Choices," Burgee 26, Nov. 1996.
Scientific Assessment of Stratospheric Ozone: 1989, vol. 1, Chap. 4, "*Halocarbon Ozone Depletion and Global Warming Potentials*", pp. 401-462.

Decision of the Technical Board of Appeal Regarding European Patent No. 0439579, Nov. 14, 2001.

Derwent Publications, Ltd., Abstract; SU715092, Feb. 15, 1980; 1 page.

* cited by examiner

FIRE EXTINGUISHING MIXTURES, METHODS AND SYSTEMS

TECHNICAL FIELD

The present invention relates generally to the field of fire extinguishment, prevention and suppression. More particularly the present invention relates to fire extinguishing mixtures, methods and systems.

BACKGROUND OF THE INVENTION

There are a multitude of known fire extinguishing agents, and methods and systems for using the same. The mechanism by which these fire extinguishing agents extinguish a fire can vary from agent to agent. For instance, some fire extinguishing agents operate by inerting or diluting mechanisms that act to deprive the fire of necessary chemicals, such as oxygen or fuels. Other fire extinguishing agents operate chemically to extinguish a fire. Such chemical actions may include scavenging free radicals, thereby breaking the reaction chain required for combustion. Still, other fire extinguishing agents operate thermally to cool the fire.

Traditionally, certain bromine-containing compounds such as Halon 1301 ($CF_3Br$), Halon 1211 ($CF_2BrCl$), and Halon 2402 ($BrCF_2CF_2Br$) have been used as fire extinguishing agents for the protection of occupied rooms. Although these Halons are effective fire extinguishing agents, some believe that they are harmful to the earth's protective ozone layer. As a result, the production and sale of these agents has been prohibited.

Relatively recently, fluorocarbons such as hydrofluorocarbons, fluoroethers and fluorinated ketones have also been proposed as effective fire extinguishing agents. Fluorocarbon systems may be relatively inefficient and can be high in cost. In addition, some fluorocarbon fire extinguishing agents may react in the flame to form various amounts of decomposition products, such as HF. In sufficient quantities, HF is corrosive to certain equipment and poses a significant health threat.

In addition to fluorocarbon agents, inert gases have been proposed as replacements for the Halon fire extinguishing agents. Gases such as nitrogen or argon, and also blends, such as a 50:50 blend of argon and nitrogen have been proposed. These agents can be very inefficient at fire extinguishing, and as a result, significant amounts of the gas are necessary to provide extinguishment. The large amounts of gases required for extinguishment results in the need for a large number of storage cylinders to store the agent, and ultimately, large storage rooms to house the gas storage cylinders.

Hybrids of fluorocarbons and gas blends have also been proposed as fire extinguishing agents. For example, U.S. Pat. No. 6,346,203 to Robin et al. proposes delivering to the fire gas and fluorocarbon fire extinguishing agents.

Finally, water mists have also been used for the suppression of compartment fires. Hybrid fire extinguishing systems utilizing a water mist followed by the application of either fluorocarbon or gas agents have been proposed.

It would desirable to develop improved fire extinguishing agents and systems.

SUMMARY OF THE INVENTION

In one aspect, the present invention provides fire extinguishing mixtures that include a diluent gas and a extinguishing compound such as fluoroethers, bromofluorocarbons, fluoroketones, and/or mixtures thereof.

Another aspect of the present invention provides a fire extinguishing mixture comprising water, a diluent gas, and an extinguishing compound that includes fluorocarbons such as hydrofluorocarbons, fluoroethers, bromofluorocarbons, fluoroketones and/or mixtures thereof.

In another aspect, a fire extinguishing mixture is provided comprising water and an extinguishing compound that includes fluorocarbons, such as hydrofluorocarbons, fluoroethers, bromofluorocarbons, fluoroketones and/or mixtures thereof.

In another aspect, a fire extinguishing mixture is provided that comprises an extinguishing compound that includes fluorocarbons such as hydrofluorocarbons, fluoroethers, bromofluorocarbons, fluoroketones and/or mixtures thereof, and a suppressing additive that includes diluent gases, water and/or mixtures thereof.

Fluoroketones useful in accordance with the present invention include $CF_3CF_2C(O)CF(CF_3)_2$, $(CF_3)_2CFC(O)CF(CF_3)_2$, $CF_3(CF_2)_2C(O)CF(CF_3)_2$, $CF_3(CF_2)_3C(O)CF(CF_3)_2$, $CF_3(CF_2)_5C(O)CF_3$, $CF_3CF_2C(O)CF_2CF_2CF_3$, $CF_3C(O)CF(CF_3)_2$, perfluorocyclohexanone and/or mixtures thereof.

Fluoroethers useful in accordance with the present invention include $CF_3CHFCF_2OCHF_2$, $CF_3CHFCF_2OCF_3$, $(CF_3)_2$ $CHOCHF_2$, $CHF_2CF_2OCF_2$, $CF_3CFHOCHF_2$, $CF_3CFHOCF_3$, $CF_2{=}C(CF_3)OCF_3$, $CF_2{=}C(CF_3)OCHF_2$, $CF_3CF{=}CFOCHF_2$, $CF_2{=}CFCF_2OCHF_2$, $CF_3CF{=}CFOCF_3$, $CF_2{=}CFCF_2OCF_3$ $CF_3CH{=}CFOCHF_2$, $CF_3CH{=}CFOCF_3$, $CF_3CHBrCF_2OCF_3$, $CF_3CFBrCF_2OCHF_2$, $CF_3CHFCF_2OCH_2Br$, $CF_2BrCF_2OCH_2CF_3$, $CHF_2CF_2OCH_2Br$ and/or mixtures thereof.

Fluorocarbons useful in accordance with the present invention include trifluoromethane ($CF_3H$), pentafluoroethane ($CF_3CF_2H$), 1,1,1,2-tetrafluoroethane ($CF_3CH_2F$), 1,1,2,2-tetrafluoroethane ($HCF_2CF_2H$), 1,1,1,2,3,3,3-heptafluoropropane ($CF_3CHFCF_3$), 1,1,1,2,2,3,3-heptafluoropropane ($CF_3CF_2CF_2H$), 1,1,1,3,3,3-hexafluoropropane ($CF_3CH_2CF_3$), 1,1,1,2,3,3-hexafluoropropane ($CF_3CHFCF_2H$), 1,1,2,2,3,3-hexafluoropropane ($HCF_2CF_2CF_2H$), 1,1,1,2,2,3-hexafluoropropane ($CF_3CF_2CH_2F$), 1,1,1,2,2-pentafluorobutane ($CF_3CH_2CF_2CH_3$), $CF_3CBr{=}CH_2$, $CF_3CH{=}CHBr$, $CF_2BrCH{=}CH_2$, $CF_2BrCF_2CH{=}CH_2$, $CF_3CBr{=}CF_2$ and/or mixtures thereof.

In an aspect of the present invention, methods are provided for extinguishing, suppressing and/or preventing fires using the mixtures of the present invention.

In an aspect of the present invention, fire extinguishing, preventing and/or suppressing systems that deliver the mixtures of the present invention are disclosed.

In an aspect of the present invention, a method for extinguishing a fire in a room comprising introducing water to the room; introducing a diluent gas into the room; and introducing an extinguishing compound.

BRIEF DESCRIPTION OF THE DRAWINGS

FIG. 1. is an illustration of an application of extinguishing mixtures in accordance with an aspect of the present invention.

DETAILED DESCRIPTION OF THE PREFERRED EMBODIMENTS

Figure 11:
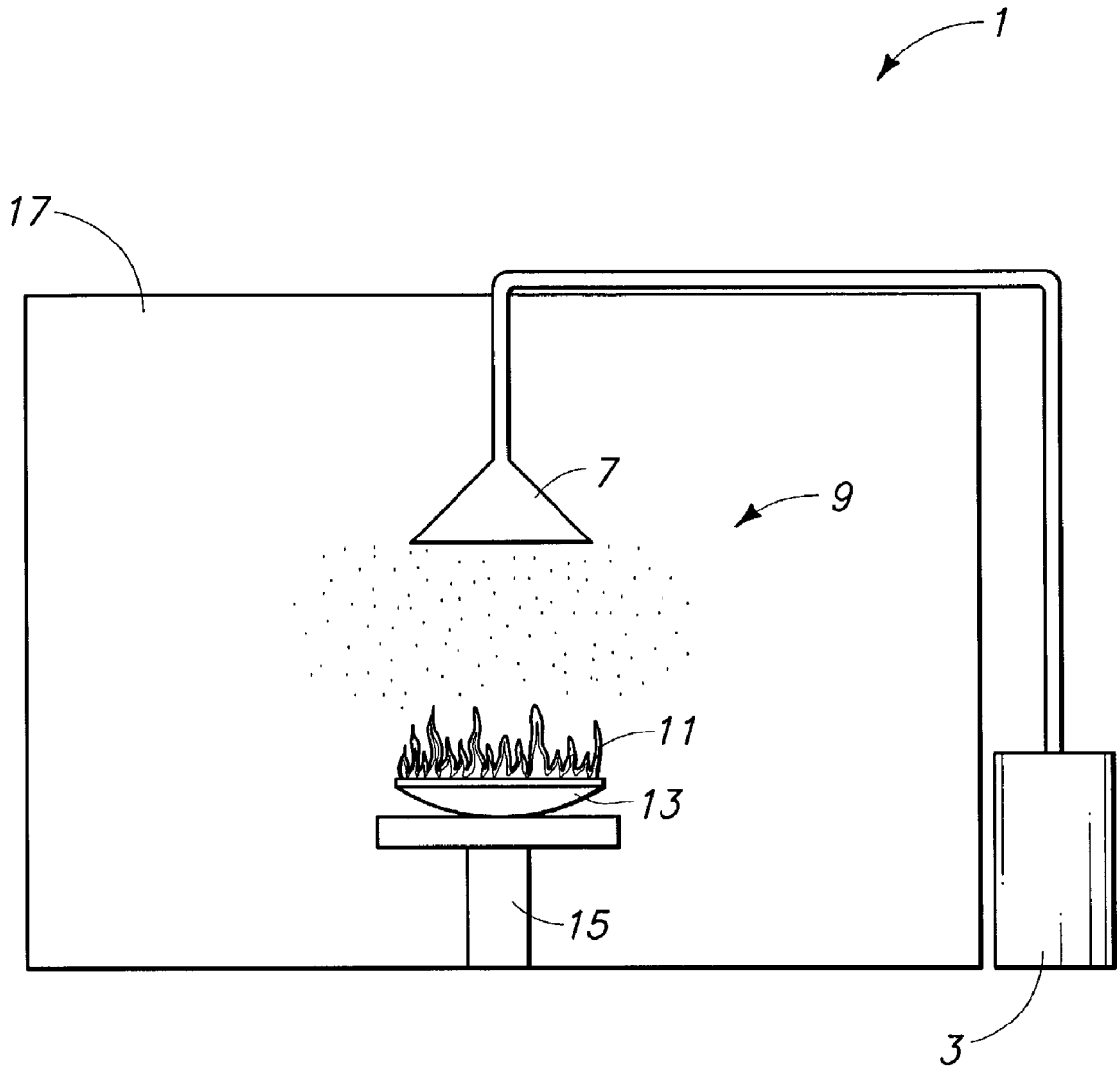

This disclosure of the invention is submitted in furtherance of the constitutional purposes of the U.S. Patent Laws "to promote the progress of science and useful arts" (Article 1, Section 8).

The present invention provides fire extinguishing mixtures which comprise blends of extinguishing agents that extinguish fires through inertion, and/or dilution, as well as, chemical, and/or thermal extinguishment. The present invention also provides methods of extinguishing, preventing and/or suppressing a fire using such fire extinguishing mixtures. The present invention further provides fire extinguishing, preventing and/or suppressing systems for delivering such fire extinguishing mixtures. Exemplary aspects of the present invention are described with reference to FIG. 1

Referring to FIG. 1, a space 17 configured with a fire extinguishing system 1 is shown. Fire extinguishing system 1 includes an extinguishing compound storage vessel 3 contiguous with an extinguishing compound dispersing nozzle 7. As depicted, a combustion 11 occurs within a pan 13 on a pedestal 15. An extinguishing mixture 9 exists within space 17 and is applied to the combustion to substantially extinguish the flame.

While depicted in two dimensions, space 17, for purposes of this disclosure, should be considered to have a volume determined from its dimensions (e.g., width, height and length). While FIG. 1 illustrates a system configured for extinguishing fires with in a space that as illustrated appears to be enclosed, the application of the mixtures, systems and methods of the present invention are not so limited. In some aspects, the present invention may be used to extinguish fires in open spaces as well as confined spaces.

All combustion suitable for extinguishment, suppression or prevention using the mixtures of the present invention or utilizing the methods and systems according to the present invention, are at least partially surrounded a space. The available volume of this space can be filled with the compositions of the present invention to extinguish, suppress and/or prevent combustion. Typically the available volume is that volume which can be occupied by a liquid or a gas (i.e. that volume within which fluids (gases and liquids) can exchange). Solid constructions are typically are not part of the available volume.

Furthermore, FIG. 1 illustrates a single extinguishing agent storage vessel 3. It should be understood that extinguishing mixture 9 can be provided to room 17 from multiple extinguishing agent storage vessels 3 and the present invention should not be limited to mixtures that can be provided from a single vessel nor methods or systems that utilize a single vessel. Generally, combustion 11 is extinguished when extinguishing mixture 9 is introduced from vessel 3 through nozzle 9 to space 17.

In one aspect of the present invention extinguishing mixture 9 can comprise, consist essentially of and/or consist of an extinguishing compound and a suppressing additive. In another aspect, extinguishing mixture 9 can comprise, consist essentially of and/or consist of an extinguishing compound and a diluent gas. In a further aspect, extinguishing mixture 9 can comprise, consist essentially of and/or consist of an extinguishing compound and water. In still another aspect, extinguishing mixture 9 can comprise, consist essentially of and/or consist of an extinguishing compound, a diluent gas and water.

The suppressing additive employed can include diluent gases, water and/or mixtures thereof. Exemplary diluent gases can include nitrogen, argon, helium, carbon dioxide and/or mixtures thereof. In an exemplary aspect these gases can deprive fires of necessary fuels, such as oxygen. In the same or other aspects these diluent gases resist decomposition when exposed to combustion. In some cases these gases are referred to as inert gases. An exemplary diluent gas can comprise, consist essentially of, and/or consist of nitrogen. In one aspect, the concentration of the diluent gas is from about 5% (v/v) to about 26% (v/v). In another aspect the diluent gas may be employed at a concentration of from about 8% (v/v) to about 32% (v/v). In another aspect the diluent gas may be employed at a concentration of from about 4% (v/v) to about 13% (v/v).

It should be understood that the % (v/v) values set forth in this description and in the claims are based on space volume and refer to the design concentration as adopted and described by the National Fire Protection Association in *NFPA* 2001, *Standard on Clean Agent Fire Extinguishing,* 2000 *edition*, the entirety of which is incorporated by reference herein. The equation used to calculate the concentration of the diluent gas is as follows:

$$X=2.303(V_s/s)\log_{10}(100/100-C)$$

where:

X=volume of diluent gas added (at standard conditions of 1.013 bar, 21° C.), per volume of hazard space. ($m^3$)

$V_s$=specific volume of diluent gas agent at 21° C. and 1.013 bar.

s=specific volume of diluent gas at 1 atmosphere and temperature, t ($m^3$/kg)

t=minimum anticipated temperature of the protected volume (° C.)

C=diluent gas design concentration (%)

In another aspect of the present invention, the suppressing additive includes water. Water may be stored and delivered by any standard water storage and delivery system. In one aspect, the water is delivered at a pressure from about 34 kPa to about 690 kPa and, in another aspect it is delivered at a pressure from about 69 kPa to about 827 kPa. In one aspect, the water is delivered at a flow rate of from about 0.03532 L\min\$m^3$ to about 1.06 L\min\$m^3$ and, in another aspect, from about 0.1766 L\min\$m^3$ to about 0.71 L\min\$m^3$.

Water may exist in the fire extinguishing mixture in the form of droplets, fog, steam, gas and/or mixtures thereof. In the case of droplets, the majority of water particles can be about 100 μm or less in diameter, and/or from about 20 μm to about 30 μm.

In the case of fog, the majority of water particles can be from about 1 μm to about 10 μm in diameter. The fog may be produced and delivered using any technique and/or system known in the art such as dual injections nozzle system. Fog might also be produced using a higher pressure nozzle system.

In the case of steam, the water may have particle sizes of less than 1 μm and may be produced and delivered using any known technique or system for vaporizing water.

The extinguishing compound can include fluorocarbons such as fluoroketones, fluoroethers and/or mixtures thereof.

Fluoroketones useful as extinguishing compounds in accordance with the present invention can include $CF_3CF_2C(O)CF(CF_3)_2$, $(CF_3)_2CFC(O)CF(CF_3)_2$, $CF_3(CF_2)_2C(O)CF(CF_3)_2$, $CF_3(CF_2)_3C(O)CF(CF_3)_2$, $CF_3(CF_2)_5C(O)CF_3$, $CF_3CF_2C(O)CF_2CF_2CF_3$, $CF_3C(O)CF(CF_3)_2$, perfluorocyclohexanone and/or mixtures thereof. The extinguishing mixture can comprise from about 0.2% (v/v) to about 10% (v/v) fluoroketone, in some applications, from about 0.1%

(v/v) to about 6% (v/v) fluoroketone and, in particular applications from about 0.5% (v/v) to about 4% (v/v) fluoroketone. The fluoroketone can comprise, consist essentially of and/or consist of $CF_3CF_2C(O)CF(CF_3)_2$. In another aspect, the extinguishing mixture comprises from about 1.7% (v/v) to about 3.8% (v/v) $CF_3CF_2C(O)CF(CF_3)_2$.

The equation used to calculate the concentrations of extinguishing compounds has likewise been adopted by the National Fire Protection Association and is as follows:

$$W=V/s(C/100-C)$$

Where:

W=weight of extinguishing compound (kg)

V=volume of test space ($m^3$)

s=specific volume of extinguishing compound at test temperature ($m^3$/kg)

C=concentration (% (v/v))

In another aspect of the present invention, the extinguishing compound can be selected from the group of fluoroethers consisting of $CF_3CHFCF_2OCHF_2$, $CF_3CHFCF_2OCF_3$, $(CF_3)_2CHOCHF_2$, $CHF_2CF_2OCF_2$, $CF_3CFHOCHF_2$, $CF_3CFHOCF_3$, $CF_2{=}C(CF_3)OCF_3$, $CF_2{=}C(CF_3)OCHF_2$, $CF_3CF{=}CFOCHF_2$, $CF_2{=}CFCF_2OCHF_2$, $CF_3CF{=}CFOCF_3$, $CF_2{=}CFCF_2OCF_3$ $CF_3CH{=}CFOCHF_2$, $CF_3CH{=}CFOCF_3$, $CF_3CHBrCF_2OCF_3$, $CF_3CFBrCF_2OCHF_2$, $CF_3CHFCF_2OCH_2Br$, $CF_2BrCF_2OCH_2CF_3$, $CHF_2CF_2OCH_2Br$ and/or mixtures thereof.

The extinguishing mixture can comprise from about 0.2% (v/v) to about 5.8% (v/v) fluoroether, in some applications from about 0.1% (v/v) to about 6.0% (v/v) fluoroether and, in particular applications from about 0.1% (v/v) to about 4.8% (v/v) fluoroether. The fluoroether can comprise, consist essentially of and/or consist of $CF_3CHFCF_2OCHF_2$. In another aspect, the extinguishing mixture can comprise from about 0.1% (v/v) to about 4.8% (v/v) $CF_3CHFCF_2OCHF_2$.

In another aspect of the present invention, the extinguishing mixture can include a bromofluoropropene selected from the group consisting of $CF_3CBr{=}CH_2$, $CF_3CH{=}CHBr$, $CF_2BrCH{=}CH_2$, $CF_2BrCF_2CH{=}CH_2$, and/or mixtures thereof. The extinguishing mixture can comprise from about 0.2% (v/v) to about 5% (v/v) bromofluoropropene, in some applications from about 0.1% (v/v) to about 5% (v/v) bromofluoropropene and, in particular applications, from about 1% (v/v) to about 3% (v/v) bromofluoropropene. The bromofluoropropene can comprise, consist essentially of and/or consist of $CF_3CBr{=}CH_2$. In an application, the extinguishing mixture can comprise from about 0.2% (v/v) to about 4.2% (v/v) $CF_3CBr{=}CH_2$, and, in some applications from about 0.2% (v/v) to about 3.0% (v/v) $CF_3CBr{=}CH_2$.

In another aspect, the extinguishing mixture can include hydrofluorocarbons selected from the group consisting of trifluoromethane ($CF_3H$), pentafluoroethane ($CF_3CF_2H$), 1,1,1,2-tetrafluoroethane ($CF_3CH_2F$), 1,1,2,2-tetrafluoroethane ($HCF_2CF_2H$), 1,1,1,2,3,3,3-heptafluoropropane ($CF_3CHFCF_3$), 1,1,1,2,2,3,3-heptafluoropropane ($CF_3CF_2CF_2H$), 1,1,1,3,3,3-hexafluoropropane ($CF_3CH_2CF_3$), 1,1,1,2,3,3-hexafluoropropane ($CF_3CHFCF_2H$), 1,1,2,2,3,3-hexafluoropropane ($HCF_2CF_2CF_2H$), 1,1,1,2,2,3-hexafluoropropane ($CF_3CF_2CH_2F$) and/or mixtures thereof. In one aspect, the extinguishing mixture can comprise from about 1% (v/v) to about 10% (v/v) hydrofluorocarbon and, in some applications, from about 3% (v/v) to about 6% (v/v) hydrofluorocarbon. The hydrofluorocarbon can comprise, consist essentially of and/or consist of heptafluoropropane. In one aspect, the extinguishing mixture can comprise from about 4% (v/v) to about 9% (v/v) heptafluoropropane.

Referring again to FIG. 1, systems according to the present invention provide for the storage and discharge of the extinguishing mixtures described above. In an exemplary aspect, the extinguishing compound may be stored in vessel 3 connected via appropriate piping and valves to discharge nozzle 7 located proximate space 17. Vessel 3 may be connected to the same nozzle 7 used to discharge the gas and/or water stored in the same or alternative vessel. Vessel 3 may be a conventional fire extinguishing agent storage cylinder fitted with a dip tube to afford delivery of the extinguishing compound, diluent gas and/or water through a piping system. The extinguishing compound in the cylinder may be super-pressurized in the cylinder using nitrogen or another gas, typically to levels of 360 or 600 psig. In the case of lower boiling extinguishing compounds, the extinguishing compound may be stored in and delivered from the vessel without the use of any super-pressurization.

In another aspect, an extinguishing system of the present invention can provide for storing the extinguishing compound as a pure material in vessel 3 to which can be connected a pressurization system (not shown) that may include the diluent gas and/or water. In this case, the extinguishing compound can be stored as a liquid in vessel 3 under its own equilibrium vapor pressure at ambient temperatures, and upon detection of a fire, vessel 3 may be pressurized by suitable means. Once pressurized to the desired level, the delivery of extinguishing mixture 9 can be activated. One method useful for delivering extinguishing mixture 9 to an enclosure is referred to as a "piston flow" method and is described in Robin, et al. U.S. Pat. No. 6,112,822, which is hereby incorporated by reference.

Methods according to the present invention include those methods that provide the extinguishing mixtures of the present invention. In one aspect, a method can include delivering water, diluent gas, and the extinguishing compound to a space simultaneously upon detection of the fire. In another aspect, upon detection of the fire the delivery of the water may be initiated first. Delivery of the diluent gas can be initiated at a later time, either during or after the water discharges. Delivery of the extinguishing compound can then be initiated after initiation of the delivery of the diluent gas.

In another aspect, methods according to the present invention provide for the delivery of both the water and the diluent gas simultaneously followed by the delivery of the extinguishing compound, either during or after the discharge of the diluent gas and water. In yet another aspect, the delivery of the diluent gas may be initiated prior to the initiation of the delivery of the water. Delivery of the water and extinguishing compound is then initiated either during or after the diluent gas is discharged.

The invention will be further described with reference to the following specific examples. However, it will be understood that these examples are illustrative and not restrictive in nature.

EXAMPLE I

Extinguishing concentrations of the fluoroketone $CF_3CF_2C(O)CF(CF_3)_2$ were determined using a cup burner apparatus, as described in M. Robin and Thomas F. Rowland, "Development of a Standard Cup Burner Apparatus: NFPA and ISO Standard Methods, 1999 Halon Options Technical Working Conference, Apr. 27–29, 1999, Albuquerque, N. Mex." and incorporated herein by reference. The cup burner method is a standard method for determining extinguishing mixtures, and has been adopted in both national and international fire suppression standards. For example NFPA 2001 Standard on Clean Agent Fire Extinguishing Systems and ISO 14520-1: Gaseous Fire-Extinguishing Systems, both utilize the cup burner method.

A mixture of air, nitrogen and $CF_3CF_2C(O)CF(CF_3)_2$ was flowed through an 85-mm (ID) Pyrex chimney around a 28-mm (OD) fuel cup. A wire mesh screen and a 76 mm (3 inch) layer of 3 mm (OD) glass beads were employed in the diffuser unit to provide thorough mixing of air, nitrogen and $CF_3CF_2C(O)CF(CF_3)_2$.

n-Heptane was gravity fed to a cup from a liquid fuel reservoir consisting of a 250 mL separatory funnel mounted on a laboratory jack, which allowed for an adjustable and constant liquid fuel level in the cup. The fuel was ignited with a propane mini-torch, the chimney was placed on the apparatus. The fuel level was then adjusted such that fuel was 1–2 mm from the ground inner edge of the cup. A 90 second preburn period was allowed, and a primary flow of air and nitrogen was initiated at 34.2 L/min.

Primary and secondary air flows were monitored by flow meters (240 and 225 tubes, respectively). Nitrogen flows were monitored with a flow meter (230 tube). Oxygen concentrations were calculated from the measured air and nitrogen flow rates. The flows were maintained until the flames were extinguished. The primary flow of 34.2 L/min was maintained in all the tests. The secondary flow of air was passed through $CF_3CF_2C(O)CF(CF_3)_2$ contained in a 1150 ml steel mixing chamber equipped with a dip-tube. The secondary flow, containing air saturated with $CF_3CF_2C(O)CF(CF_3)_2$, exited the mixing chamber and was mixed with the primary air flow before entering the cup burner's diffuser unit.

Immediately following flame extinction, a sample of the gas stream at a point near the lip of the cup was collected through a length of plastic tubing attached to a Hamilton three way valve and multifit gas syringe. The sample was then subjected to gas chromatographic analysis (G.C.). G.C. calibration was performed by preparing standards samples in a 1 L Tedlar bag.

A summary of test parameters and results are shown below in Table 1.

TABLE 1

Extinguishment of n-heptane Flames with $CF_3CF_2C(O)CF(CF_3)_2$

| Total Air Flow [Primary + Secondary] (L/min) | $N_2$ (L/min) | $N_2$ % (v/v) | $O_2$ % (v/v) | $CF_3CF_2C(O)CF(CF_3)_2$ % (v/v) |
|---|---|---|---|---|
| 38.7 | 0.0 | 0.0 | 20.6 | 4.1 |
| 39.0 | 2.1 | 5.2 | 19.5 | 3.8 |
| 37.7 | 3.3 | 8.0 | 18.9 | 3.4 |
| 37.7 | 4.5 | 10.6 | 18.4 | 3.1 |
| 36.8 | 5.7 | 13.5 | 17.8 | 2.8 |
| 36.3 | 7.0 | 16.2 | 17.3 | 2.4 |
| 36.3 | 8.3 | 18.6 | 16.8 | 2.1 |
| 35.9 | 9.6 | 21.1 | 16.3 | 1.8 |
| 35.8 | 10.9 | 23.4 | 15.8 | 1.5 |
| 35.4 | 12.2 | 25.6 | 15.3 | 1.2 |
| 34.2 | 15.4 | 30.6 | 14.3 | 0 |

EXAMPLE II

Example I was repeated, substituting, in once instance the bromofluoropropene $CF_3CBr{=}CH_2$, alone (under ambient oxygen conditions) for $CF_3CF_2C(O)CF(CF_3)_2$, and, in another instance, $CF_3CBr{=}CH_2$ in combination with diluent gas (reduced oxygen conditions) for $CF_3CF_2C(O)CF(CF_3)_2$. A summary of test parameters and results are shown below in Tables 2 and 3 respectively.

TABLE 2

Extinguishment of n-heptane Flames with $CF_3CBr{=}CH_2$

| Total Flow (L/min.) | $CF_3CBr{=}CH_2$ % (v/v) |
|---|---|
| 35.42 | 3.7 |
| 42.66 | 3.7 |
| 42.32 | 3.5 |
| 42.54 | 3.6 |
| 42.54 | 3.9 |
| 42.54 | 3.6 |
| | Avg. = 3.7 |
| | STDEV = 0.2 |
| | High = 3.9 |
| | Low = 3.5 |

TABLE 3

Extinguishment of n-heptane flames with $CF_3CBr{=}CH_2$ and $N_2$*

| Total Flow L/min | $N_2$ (L/min) | $N_2$ % (v/v) | $O_2$ % (v/v) | $CF_3CBr{=}CH_2$ % (v/v) |
|---|---|---|---|---|
| 35.4 | 0 | 0.0 | 20.6 | 3.7 |
| 35.7 | 2.1 | 5.7 | 19.4 | 3.0 |
| 38.5 | 3.5 | 9.2 | 18.7 | 1.9 |
| 40.8 | 6.0 | 14.7 | 17.6 | 1.4 |
| 41.6 | 7.0 | 16.9 | 17.1 | 1.0 |
| 44.9 | 10.6 | 23.6 | 15.7 | 0.4 |
| 46.5 | 12.2 | 26.2 | 15.2 | 0.2 |
| 49.0 | 14.8 | 30.2 | 14.4 | 0.0 |

*Primary air flow 34.2 L/min.

As indicated in Table 2, under ambient oxygen conditions the concentration of $CF_3CBr{=}CH_2$ required to extinguish n-heptane flames averages 3.7% (v/v). Table 3 demonstrates that when used in combination with nitrogen, $CF_3CBr{=}CH_2$ extinguishes the n-heptane flames at a much lower concentration, as low as about 0.41% (v/v), while maintaining human-safe oxygen levels.

EXAMPLE III

Example I was repeated, substituting the fluoroether $CF_3CHFCF_2OCHF_2$ for $CF_3CF_2C(O)CF(CF_3)_2$. A summary of the test parameters and results are shown below in Table 4.

TABLE 4

Extinguishment of n-heptane Flames with $CF_3CHFCF_2OCHF_2$ and $N_2$

| Total Flow (L/min.) | $N_2$ Flow (L/min) | $N_2$ % (v/v) | $O_2$ % (v/v) | $CF_3CHFCF_2OCHF_2$ % (v/v) |
|---|---|---|---|---|
| 31.7 | 0 | 0 | 20.6 | 5.7 |
| 31.2 | 2.89 | 8.5 | 19.9 | 4.8 |
| 31.0 | 4.16 | 11.8 | 18.2 | 4.3 |

TABLE 4-continued

| Extinguishment of n-heptane Flames with $CF_3CHFCF_2OCHF_2$ and $N_2$ | | | | |
|---|---|---|---|---|
| Total Flow (L/min.) | $N_2$ Flow (L/min) | $N_2$ % (v/v) | $O_2$ % (v/v) | $CF_3CHFCF_2OCHF_2$ % (v/v) |
| 29.9 | 6.00 | 16.7 | 17.2 | 3.3 |
| 29.6 | 7.34 | 19.9 | 16.5 | 2.8 |
| 28.6 | 8.71 | 23.4 | 15.8 | 1.8 |
| 27.8 | 10.80 | 28.0 | 14.8 | 0.9 |
| 27.3 | 12.80 | 31.9 | 14.0 | 0.0 |

EXAMPLE IV

Example I was repeated, substituting the hydrofluorocarbon $CF_3CH_2F$ for $CF_3CF_2C(O)CF(CF_3)_2$. A summary of the test parameters and results are shown below in Table 5.

TABLE 5

| Extinguishment of n-heptane Flames with $CF_3CH_2F$ and $N_2$ | | | | |
|---|---|---|---|---|
| Total Flow (L/min.) | $N_2$ Flow (L/min) | $N_2$ % (v/v) | $O_2$ % (v/v) | $CF_3CH_2F$ % (v/v) |
| 41.1 | 0 | 0 | 20.6 | 9.6 |
| 41.1 | 3.29 | 7.4 | 19.1 | 7.9 |
| 41.1 | 6.58 | 13.8 | 17.8 | 6.2 |
| 41.1 | 9.66 | 19 | 16.7 | 4.5 |
| 41.1 | 12.2 | 22.9 | 15.9 | 3.3 |
| 41.1 | 14.8 | 26.9 | 15.1 | 1.6 |
| 41.1 | 18.4 | 30.9 | 14.2 | 0 |

EXAMPLE V n-Heptane fires where extinguished utilizing an extinguishing mixture according to the present invention. The fire extinguishing tests were conducted according to the test protocol described in UL-2166. More specifically, Class B fire extinguishing tests were conducted using a 0.23 $m^2$ square test pan located in the center of a room. The test pan contained at least 5.08 cm of n-heptane with at least 5.08 cm of free board from the top of the pan. The pan was made of steel having a thickness of 0.635 cm and liquid tight welded joints. The pan also included a 3.81 cm (1½") (3/16" thickness) angle to reinforce the upper edge.

The internal dimensions of the test facility (room) were 8 m×4 m×3.6 m (height); precise measurement of the test portion of the facility yielded a total volume of 115 $m^3$. The enclosure walls were constructed of standard concrete cinder block, filled with insulation and covered on the interior with 1.59 cm plywood. The ceiling and floor both consisted of two layers of 1.91 cm plywood on wooden 5.08 cm×15.24 cm joists, with alternate layers of plywood staggered so that no joints overlapped. The ceiling was also covered with 1.59 cm gypsum wallboard, and the walls and ceiling were finished with tape and joint compound and painted with two coats of primer (Kilz). The windows consisted of standard units employing safety glass and were covered on the interior with Lexan sheets. The enclosure door was of standard solid core construction.

A 45.72 cm×45.72 cm hinged positive pressure vent installed in a recess in the ceiling was kept open during testing. The ventilation inlet to the enclosure, through an underfloor duct, remained closed during this evaluation. A 3.5 ton commercial heat pump unit provided temperature control of the room. The inlet and outlet ducts were equipped with closable shutters. The exhaust system was also fitted with a closable shutter.

Water spray was discharged at 45 seconds from ignition and continued until extinguishment. The water spray flow rate is shown in Table 5. Water spray was provided using 6 "90 degree solid cone nozzles". These nozzles were installed approximately 150 cm from the ceiling and were installed to cover the whole area of the floor. In some part of the space, there was an overlap of the spray. Heptafluoropropane was discharged 60 seconds from the beginning of water spray discharge (105 seconds from ignition). Each test was conducted at least three times and the parameters and results are summarized in Table 6.

TABLE 6

| Extinguishment of n-heptane Flames with Water and Heptafluoropropane | | | | |
|---|---|---|---|---|
| Test # | Heptafluoropropane % (v/v) | Heptafluoropropane (kg) | Water (L/min) | Average Extinguishment Time (sec.) |
| 1 | 8.7 | 79.83 | 42.03 | 1.0 |
| 2 | 7.0 | 63.05 | 19.69 | 6.4 |
| 3 | 5.8 | 51.71 | 42.03 | 12.6 |
| 4 | 5.0 | 44.09 | 42.03 | 16.0 |
| 5 | 4.5 | 39.46 | 42.03 | 24.53 |

EXAMPLE VI

Extinguishment testing was performed as described in Example IV above with the exception that the extinguishing mixture included nitrogen. Nitrogen was discharged from cylinders, pressurized to 13.79 mPa, corresponding to 5.18 $m^3$ of nitrogen at 1 atmosphere and 21.1° C. The cylinders were connected to an end draw manifold via 1.59 cm high pressure flex hoses and cylinder actuation was accomplished via a remote manual lever release actuator. A 3.18 cm orifice union with an orifice plate connected the manifold to the remaining pipe network. This system was designed to afford a 60 second discharge of nitrogen at a concentration of 30% (v/v), and employed a centrally located 2.54 cm (1"), 360° Ansul® (Marinette, Wis., USA) nozzle with an orifice of 1.43 $cm^2$. The same nitrogen piping system was employed for all tests and hence discharge times varied with the amount of nitrogen employed.

Water and nitrogen were discharged into the test enclosure 30 seconds after n-heptane ignition, and continued to discharge until flame extinguishment. The water spray was discharged at the rate of 62.47 L/min. At 50 seconds from the beginning of the nitrogen discharge (i.e., 80 seconds from n-heptane ignition), heptafluoropropane was discharged through a separate pipe system terminating in a 5.08 cm (2") 180° Chubb nozzle. Each test was conducted at least three times and the parameters and results are summarized below in Table 7.

TABLE 7

| Extinguishment of n-heptane Flames with Water/Nitrogen/Heptafluoropropane | | | | |
|---|---|---|---|---|
| Test # | Hepta-fluoropropane % (v/v) | Heptafluoropropane (kg) | $N_2$ % (v/v) | Average Extinguishment Time (sec.) |
| 1 | 4.3 | 37.65 | 4.4 | 17.4 |
| 2 | 4.3 | 37.65 | 8.6 | 22.2 |
| 3 | 3.5 | 30.39 | 8.6 | 36.6 |
| 4 | 3.5 | 30.39 | 12.6 | 18.7 |

EXAMPLE VII

The test in Example V was repeated using n-Heptane alternative fuels, namely PMMA (polymethyl methacrylate), PP (polypropylene), ABS (acrylonitrile-butadiene-styrene polymer) or wood and permitting a longer preburn. Water spray and nitrogen were discharged into the test enclosure at 210 seconds after ignition (360 seconds in the case of wood), and continued to discharge until flame extinguishment. Heptafluoropropane was discharged at 260 seconds (420 seconds in the case of wood) from ignition and continued for between 8 and 10 seconds. A summary of the parameters and results are shown below in Table 8.

TABLE 8

| Extinguishment of Alternative Fuel Flames with Water/Nitrogen/Heptafluoropropane | | | | |
|---|---|---|---|---|
| Fuel Type | Hepta-fluoropropane % (v/v) | Heptafluoropropane (kg) | $N_2$ % (v/v) | Extinguishment Time (sec) |
| PMMA | 3.5 | 30.39 | 12.6 | 12 |
| PMMA | 3.5 | 30.39 | 12.6 | 27 |
| PP | 3.5 | 30.39 | 12.6 | 64 |
| ABS | 3.5 | 30.39 | 12.6 | 88 |
| Wood | 3.5 | 30.39 | 12.6 | <1 |

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A mixture within a space, comprising:

at least two components; a first component of the at least two components comprising a diluent gas; a second component of the at least two components comprising an extinguishing compound, wherein the extinguishing compound comprises one or more of $CF_3CBR{=}CH_2$, $CF_3CH{=}CHBr$, $CF_2BrCH{=}CH_2$, and $CF_2BrCF_2CH{=}CH_2$; and wherein the first component comprises from about 4% (v/v) to about 28% (v/v) of the space.

2. The mixture of claim 1 wherein the diluent gas comprises nitrogen.

3. The mixture of claim 1 wherein the extinguishing compound comprises $CF_3CBr{=}CH_2$.

4. The mixture of claim 3 wherein the $CF_3CBr{=}CH_2$ comprises from about 0.2% (v/v) to about 4.2% (v/v) of the space.

5. The mixture of claim 1 wherein the extinguishing compound consists essentially of $CF_3CBr{=}CH_2$.

6. The mixture of claim 1 wherein the extinguishing compound consists of $CF_3CBr{=}CH_2$.

7. A mixture within a space, comprising:

at least three components; a first component of the at least three components comprising a diluent gas; a second component of the at least three components comprising an extinguishing compound; a third component of the at least three components comprising water, wherein the water particle size is about 100 μm; and wherein the first component comprises from about 4% (v/v) to about 28% (v/v) of the space.

8. A mixture within a space, comprising:

at least three components; a first component of the at least three components comprising a diluent gas; a second component of the at least three components comprising an extinguishing compound; a third component of the at least three components comprising water, wherein the extinguishing compound comprises $CF_3CF_2C(O)CF(CF_3)_2$; and wherein the first component comprises from about 4% (v/v) to about 28% (v/v) of the space, and the $CF_3CF_2C(O)CF(CF_3)_2$ comprises from about 1.7% (v/v) to about 3.8% (v/v) of the space.

9. A mixture within a space, comprising:

at least two components; a first component of the least two components comprising a fluorocarbon; a second component of the at least two components comprising water; and wherein the first component comprises from about 1% (v/v) to about 10% (v/v) of the space.

10. The mixture of claim 9 wherein the fluorocarbon is selected from the group comprises one or more of trifluoromethane ($CF_3H$), pentafluoroethane ($CF_3CF_2H$) 1,1,1,2-tetrafluoroethane ($CF_3CH_2F$), 1,1,2,2-tetrafluoroethane ($HCF_2CF_2H$), 1,1,1,2,3,3,3-heptafluoropropane ($CF_3CHFCF_3$), 1,1,1,2,2,3,3-heptafluoropropane ($CF_3CF_2CF_2H$), 1,1,1,3,3,3-hexafluoropropane ($CF_3CH_2CF_3$), 1,1,1,2,3,3-hexafluoropropane ($CF_3CHFCF_2H$), 1,1,2,2,3,3-hexafluoropropane ($HCF_2CF_2CF_2H$), 1,1,1,2,2,3-hexafluoropropane ($CF_3CF_2CH_2F$), 1,1,1,2,2-pentafluorobutane ($CF_3CH_2CF_2CH_3$), $CF_3CBr{=}CH_2$, $CF_3CH{=}CHBr$, $CF_2BrCH{=}CH_2$, $CF_2BrCF_2CH{=}CH_2$ and $CF_3CBr{=}CF_2$.

11. The mixture of claim 9 wherein the fluorocarbon comprises heptafluoropropane.

12. The mixture of claim 11 wherein the heptafluoropropane comprises from about 4% (v/v) to about 9% (v/v) of the space.

13. The mixture of claim 9 wherein the fluorocarbon consists essentially of heptafluoropropane.

14. The mixture of claim 9 wherein the fluorocarbon consists of heptafluoropropane.

15. The mixture of claim 9 wherein the water particle size is about 100 μm.

16. A mixture within a space comprising:

at least two components; a first component of the at least two components comprising an extinguishing compound comprising one or more of fluoroethers, bromofluoropropenes and fluoroketones; and a second component of the at least two components comprising a suppressing additive comprising water.

17. The mixture of claim 16 wherein the suppressing additive further comprises a diluent gas and the diluent gas comprises nitrogen.

18. The mixture of claim 17 wherein the nitrogen comprises from about 4% (v/v) to about 28% (v/v) of the space.

19. The mixture of claim 16 wherein the extinguishing compound comprises $CF_3CF_2C(O)CF(CF_3)_2$.

20. The mixture of claim 19 wherein the $CF_3CF_2C(O)CF(CF_3)_2$ comprises from about 1.7% (v/v) to about 3.8% (v/v) of the space.

21. The mixture of claim 16 wherein the extinguishing compound comprises $CF_3CHFCF_2OCHF_2$.

22. The mixture of claim 21 wherein the $CF_3CHFCF_2OCHF_2$ comprises from about 0.2% (v/v) to about 4.8% (v/v) of the space.

23. The mixture of claim 16 wherein the water particle size about 100 μm.

24. A mixture within a space, comprising at least two components; a first component of the at least two components comprising an extinguishing compound comprising $CF_3CBr{=}CH_2$; and a second component of the at least two components comprising a suppressing additive selected from the group comprising a diluent gas or water.

25. The mixture of claim 24 wherein the $CF_3CBr{=}CH_2$ comprising from about 0.2% (v/v) to about 4.2% (v/v) of the space.

26. A method for one or more of extinguishing, suppressing or preventing a fire in a space by introducing to the space a mixture comprising a diluent gas and an extinguishing compound comprising $CF_3CBr{=}CH_2$.

27. The method of claim 26 wherein the diluent gas comprises nitrogen.

28. The system of claim 27 wherein the nitrogen comprises from about 4% (v/v) to about 28% (v/v) of the space.

29. The system of claim 26 wherein the $CF_3CBr{=}CH_2$ comprises from about 0.2% (v/v) to about 4.2% (v/v) of the space.

30. A method for one or more of extinguishing, supressing or preventing a fire in a space by introducing to the space a mixture comprising:

a diluent gas;

an extinguishing compound selected from the group comprising fluoroethers, bromofluoropropenes or fluoroketones; and water, wherein the water particle size is about 100 μm.

31. A method for at least one of extinguishing, suppressing or preventing a fire in a space by introducing to the space a mixture comprising:

at least two components; a first component of the at least two components comprising a fluorocarbon; a second component of the at least two components comprising water; and wherein the first component comprises from about 1% (v/v) to about 10% (v/v) of the space.

32. The method of claim 31 wherein the fluorocarbon comprises heptafluoropropane.

33. A fire extinguishing, preventing or suppressing system configured to introduce to a space a mixture comprising:

a diluent gas;

an extinguishing compound selected from the group comprising fluoroethers, bromofluoropropenes or fluoroketones; and water.

34. The system of claim 33 wherein the diluent gas comprises nitrogen.

35. The mixture of claim 34 wherein the nitrogen comprises from about 4% (v/v) to about 28% (v/v) of the space.

36. The system of claim 33 wherein the extinguishing compound comprises $CF_3CF_2C(O)CF(CF_3)_2$.

37. The system of claim 36 wherein the $CF_3CF_2C(O)CF(CF_3)_2$ comprises from about 1.0% (v/v) to about 4.0% (v/v) of the space.

38. The system of claim 33 wherein the extinguishing compound comprises $CF_3CHFCF_2OCHF_2$.

39. The system of claim 38 wherein the $CF_3CHFCF_2OCHF_2$ comprises from about 0.1% (v/v) to about 4.8% (v/v) of the space.

40. A fire extinguishing, preventing or suppressing system configured to introduce to a space a mixture comprising a diluent gas and an extinguishing compound comprising $CF_3CBr{=}CH_2$.

41. The method of claim 40 wherein the $CF_3CBr{=}CH_2$ comprises from about 0.2% (v/v) to about 4.2% (v/v) of the space.

42. The system of claim 40 wherein the mixture further comprises water.

43. The system of claim 42 wherein the water particle size is about 100 μm.

44. A fire extinguishing, preventing or suppressing system configured to introduce to a space a mixture comprising:

at least two components; a first component of the at least two components comprising a fluorocarbon; a second component of the at least two components comprising water; and wherein the first component comprises from about 4% (v/v) to about 9% (v/v) of the space.

45. The system of claim 44 wherein the fluorocarbon comprises heptafluoropropane.

* * * * *